US006938572B1

(12) United States Patent
Besecker et al.

(10) Patent No.: US 6,938,572 B1
(45) Date of Patent: Sep. 6, 2005

(54) SWIM LIFT PLATFORM

(76) Inventors: Lucky W. Besecker, 2802 10th St., Englewood, FL (US) 34224; Rachael B. Besecker, 2802 10th St., Englewood, FL (US) 34224

( * ) Notice: Subject to any disclaimer, the term of this patent is extended or adjusted under 35 U.S.C. 154(b) by 0 days.

(21) Appl. No.: 10/633,725

(22) Filed: Aug. 4, 2003

Related U.S. Application Data

(60) Provisional application No. 60/403,038, filed on Aug. 13, 2002.

(51) Int. Cl.[7] ..... B63B 17/00
(52) U.S. Cl. ..... 114/361
(58) Field of Search ..... 114/361, 259, 365, 114/366; 182/84, 85, 141, 148

(56) References Cited

U.S. PATENT DOCUMENTS

| | | | | |
|---|---|---|---|---|
| 3,774,720 | A * | 11/1973 | Hovey | 182/91 |
| 3,908,794 | A * | 9/1975 | Stone | 182/91 |
| 5,224,437 | A * | 7/1993 | Stanescu | 114/362 |
| 6,003,463 | A * | 12/1999 | Giesler | 114/259 |
| 6,047,659 | A * | 4/2000 | Schmidt, Jr. | 114/369 |
| 6,591,770 | B1 * | 7/2003 | Blackmore | 114/48 |
| 6,789,648 | B2 * | 9/2004 | Cook | 182/86 |
| 6,793,039 | B2 * | 9/2004 | Schmid, Jr. | 182/84 |
| 2004/0144296 | A1 * | 7/2004 | Houlder et al. | 114/343 |

* cited by examiner

*Primary Examiner*—Sherman Basinger
(74) *Attorney, Agent, or Firm*—Gifford, Krass, Groh, Sprinkle, Anderson & Citkowski, P.C.

(57) ABSTRACT

A swim lift platform using hydraulic force to lift a swimmer between positions in which the platform is above water level to a submerged position. The movement is under the control of a swimmer occupying the platform.

7 Claims, 3 Drawing Sheets

SWIM LIFT PLATFORM

REFERENCE TO RELATED APPLICATION

This application claims priority from U.S. Provisional Patent Application Ser. No. 60/403,038 filed Aug. 13, 2002, the content of which is incorporated herein by reference.

FIELD OF THE INVENTION

This invention relates to swim platforms for boats and more particularly to a swim platform which can be adjusted in elevation by the use of hydraulic power.

BACKGROUND OF THE INVENTION

Swim platforms have been mounted on the transoms of boats but usually such platforms are supported in a fixed position or can be folded to a transport position. Typically, ladders are attached to permit a user to enter the water and to return from the water to the platform.

There is a need for a swim platform to facilitate movement from the boat to the water and from the water back to the boat without the need for physical exertion required by ladders.

SUMMARY OF THE INVENTION

It is an object of the invention to provide a swim platform which can be supported from the stern transom of a boat in a position to move vertically downwardly and to return to its initial position under the control of the person using the swim platform.

It is a further object of the invention to provide a vertically adjustable and moveable swim platform which affords a method of moving from the boat to the water and from the water back into the boat using a minimum amount of strength and energy.

The objects of the invention are attained by an arrangement which includes a pair of parallel spaced apart guide members mounted in a stationary position vertically at the transom of the boat and having a lift platform attached at its opposite sides to guided members complementary to the guide members for sliding vertical movement relative to each other. A single hydraulic actuator is supported between the guide and guided members and has its cylinder end fixed relative to the transom of the boat and its rod end acting on the lift platform. The hydraulic cylinder is a two-way cylinder and has a connection to an electrically powered hydraulic pump and hydraulic system. The pump is under the control of an electric switch mounted or stored in a readily available access position and moveable with movement of the swim platform.

DETAILED DESCRIPTION

Figure 1:
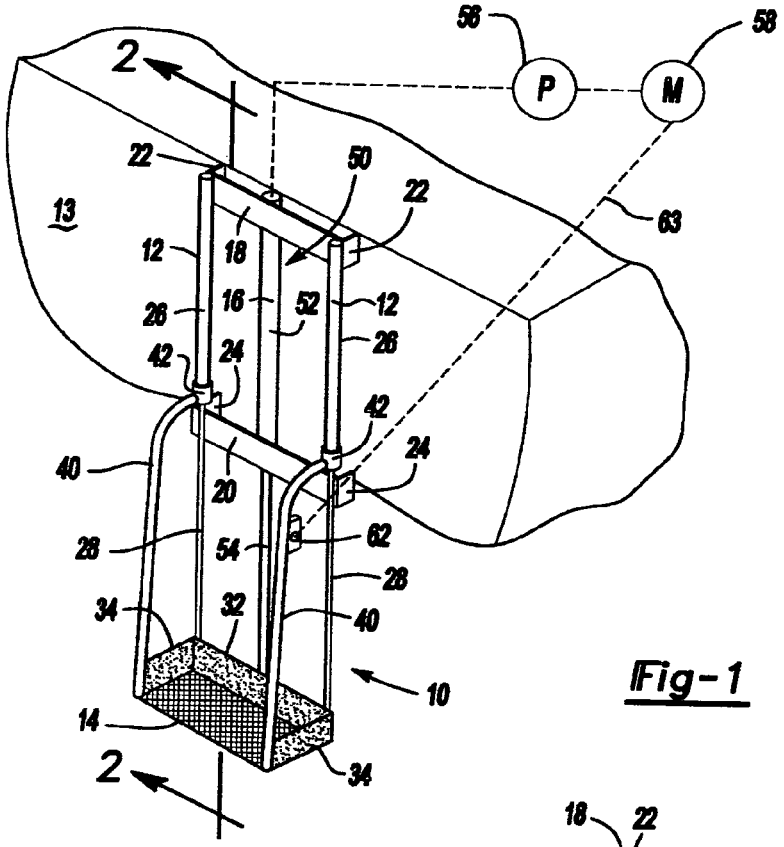
FIG. 1 is a perspective view of one embodiment of the swim lift platform embodying the invention mounted on the transom of a boat looking from the aft, starboard side of the boat and shown in its lowered position.

The swim lift platform embodying the present invention is designated generally at 10 and includes a pair of parallel spaced telescoping guide members 12 which are supported in a stationary position relative to the transom 13 of a boat. The lower ends of the guide members 12 support a platform 14 which is moved vertically relative to the transom of the boat by a double acting hydraulic actuator 16.

The guide members 12 are held in parallel spaced apart relationship by an upper and lower support member 18 and 20, respectively, which acts to hold the guide members in fixed relationship relative to each other. The upper ends of the guide members 12 are further supported in spaced relation from the transom of the boat by a pair of upper brackets 22 and the lower ends by a pair of lower brackets 24. The brackets 22 and 24 may be made of various sizes to accommodate variations in the angle of the transoms of boats on which the swim lift platform 10 is mounted. Typically the guide members 12 may be made of stainless steel tubing and each includes an outer tube 26, and a telescoping inner tube 28. The lower ends of the inner tubes 28 are attached to the horizontal platform 14. The platform 14 is provided with a forward wall or guard member 32 and a pair of side guard members 34 that serve to protect the feet of a user standing on the platform 14. The members 32 and 34 as well as the platform 14 are made of metal such as stainless steel and preferably are perforated or in the form of a grille to permit water flow and at the same time offer a non-skid surface as well as be comfortable upon contact by the feet of a user.

Figure 2:
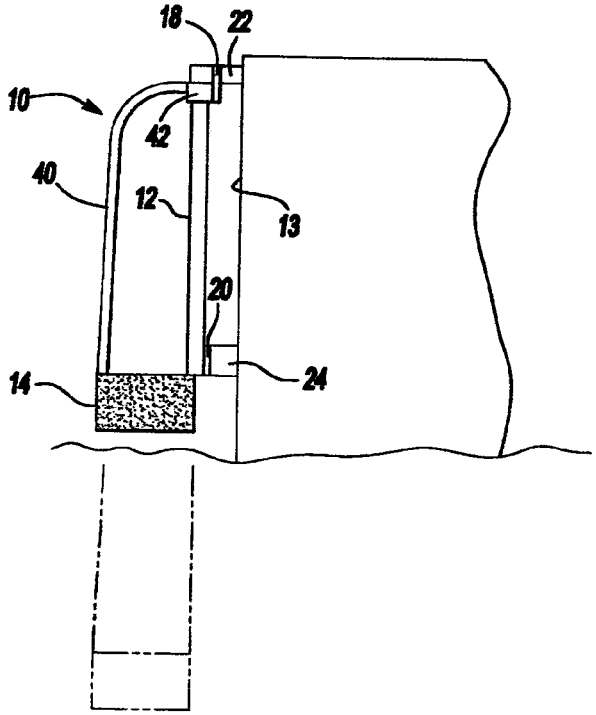
FIG. 2 is a side view taken generally on line 2—2 in FIG. 1 showing the lift platform in its upper or transport position.

A pair of handle bars 40 are disposed to opposite sides of the platform 14 and extend from the platform 14 upwardly to support collars 42 that slide on the exterior outer tube 26 of the guide members 12 during vertical up and down movement of the platform 14 between the lowered position seen in FIG. 1 and the upper transport position seen in full line in FIG. 2. The platform 14, the inner guide tubes 28 and handlebars 40 all move as a unit and are regarded as forming a platform assembly or carriage.

A hydraulic actuator 16 having a hydraulic cylinder 52 and extendable piston rod 54 is disposed between the guide members 12 and rearwardly of the support members 18 and 20. The hydraulic cylinder 52 is mounted in a fixed position relative to the boat transom 13 and more particularly to the upper support member 18 and lower support member 20. The rod end 54 is attached to the swim platform 14. The hydraulic actuator 16 is connected hydraulically to a pump system indicated at 56 that is driven by an electric direct current motor 58. The motor 58 and the hydraulic pump system 56 are under the control of an electrical control switch 62 which is detachably supported by one of the handlebars 40 for easy reach by the user and is connected electrically by a flexible connector 63 seen in FIG. 1. Actuation of the switch 62 determines the direction and amount of movement of the hydraulic actuator 16.

In its storage position with the hydraulic actuator 16 in its collapsed condition the platform is at the lower end of the boat transom and near the water level as seen in FIG. 2. The user can leave the cockpit of the boat to stand on the platform 14. Subsequent operation of the switch 62 causes operation of the hydraulic actuator so that the rod 54 extends from the cylinder 52 causing the platform 14 to be lowered together with the handle bars 40, the upper ends of which slide on the guide members 12. At the lower end of travel on the platform 12, as seen in FIG. 1, the user is partially immersed in water and can leave the platform.

To return from the water to the boat, the user steps on the platform 14 and actuates the switch 62 in an upward direction so that the rod 54 retracts into the hydraulic cylinder 52 lifting the platform 14 to its original position where the user may leave the platform and re-enter the boat.

Figure 3:
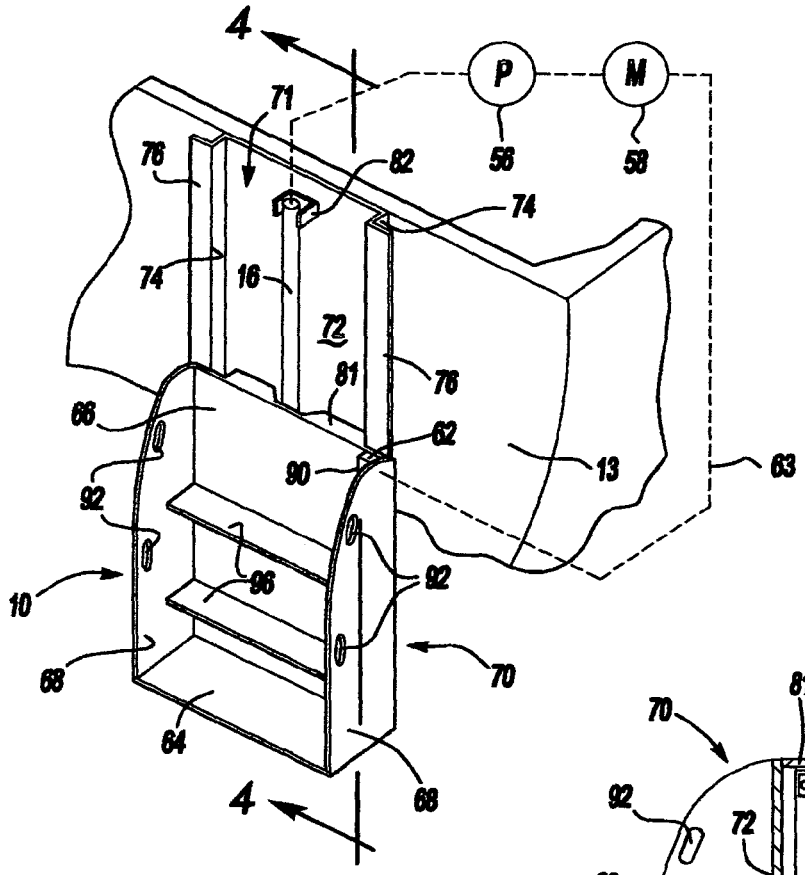
FIG. 3 is a perspective view of another embodiment of the invention similar to FIG. 1.
Figure 4:
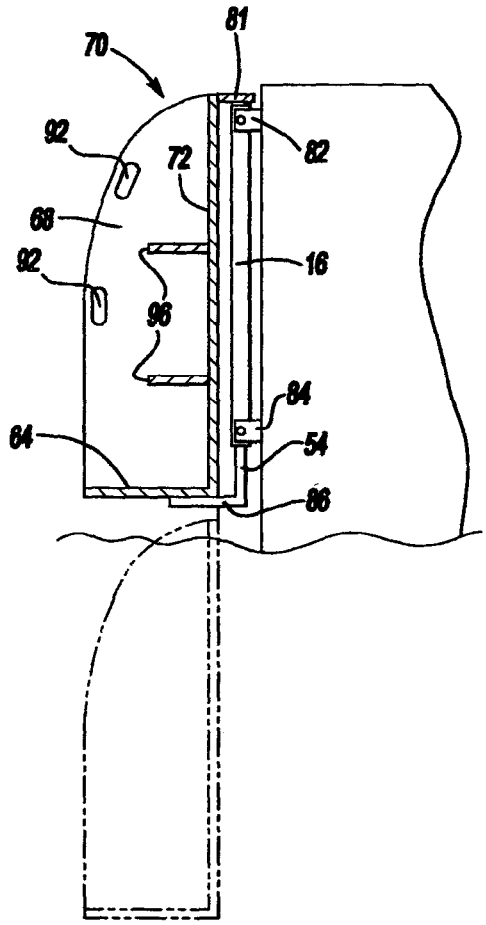
FIG. 4 is a side view taken in the direction of line 4—4 in FIG. 3 showing the lift platform in its upper transport position.
Figure 5:
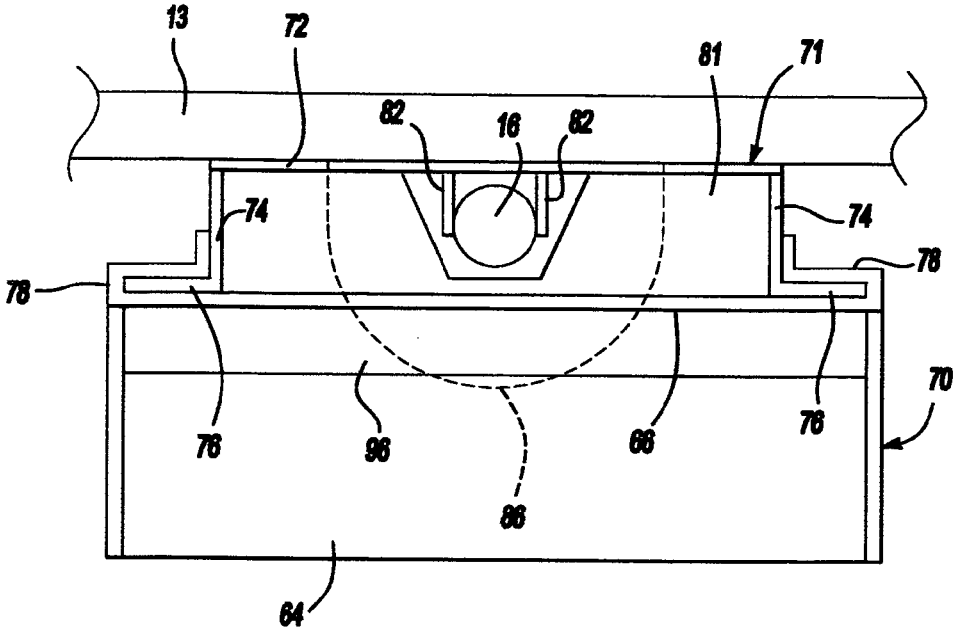
FIG. 5 is a top view of the structure seen in FIG. 4 but at an enlarged scale.

Another embodiment of the invention is shown in FIGS. 3 through 5 in which the swim lift platform 10 has a foot supporting platform 64 with a forward wall or guard 66 and an opposed pair of side walls or guards 68 which are formed integrally with each other to form a platform carriage assembly indicated at 70 in FIG. 3. In this case, guard walls 66 and 68 extend the full height of the carriage 70.

The platform carriage 70 is supported vertically on the transom 13 of a boat by a pan-like mounting structure 71 having a support wall 72 and a pair of opposed side walls 74 each having flange portions extending outwardly from each other to form stationary guide members 76. Support wall 72 of the mounting structure 71 is intended to be supported vertically relative to the transom 13 of a boat. In the case of a vertical transom the support wall 72 can be fastened in abutting relation directly to the transom of the boat. If the transom is not vertical, brackets or spacers (not shown) can be used to position the mounting structure 71 vertically.

The platform carriage 70 is provided with a pair of bracket portions 78 extending rearwardly of the guard wall 66 as seen in FIG. 5 to form a guide track to slidably receive the pair of stationary guide members 76 so that the platform carriage assembly 70 can have guided sliding movement. The top edge of forward wall 66 is provided with a shield in the form of a horizontal shelf 81 which closes the upper end of the space formed by the mounting structure 71 but allows space for the hydraulic actuator 16.

Movement of the platform carriage assembly 70 is achieved with the same hydraulic actuator 16 used in the embodiment shown in FIGS. 1 and 2. The hydraulic actuator 16 has a cylinder 52 and extendable rod portion 54 supported in the space afforded between the back of the guard wall 66 and the support wall 72 of the mounting structure 71. The hydraulic actuator 16 is held centrally between the opposite sidewalls 74 of the mounting structure 71 by an upper pair of brackets 82 at opposite sides of the cylinder 52. Similarly, the lower end of the cylinder is held by a bracket 84.

The end of the hydraulic actuator rod 54 is connected to carriage lift member 86 which extends radially from the rod 54 to engage the bottom of the platform 64 of the carriage assembly 70. The hydraulic actuator 16 of the structure seen in FIGS. 3, 4 and 5 is connected to the hydraulic pump system in the same manner as the hydraulic actuator 16 seen in FIG. 1. The electric control switch 62 seen in FIG. 1 is connected electrically by a flexible conductor 63 and in the embodiment of the invention seen in FIG. 3, the control switch 62 can be held in a bracket 90 indicated at the upper portion of the platform carriage 70. The switch 62 can be removed from the bracket to other positions of operation as determined by the length of the conductor 63.

The operation of the embodiment seen in FIGS. 3 through 5 is generally the same as the operation of the embodiment disclosed in FIGS. 1 and 2.

All of the components of the platform carriage 70, the mounting structure 71 and the hydraulic actuator preferably are made of stainless steel.

Operation by the operator standing on the platform 64 is accomplished by using the switch 62 which has "up" and "down" marked portions. Actuation of switch 62 can be initiated by pressing the "down" switch and holding it engaged until the desired elevation of the platform 64 is attained. Releasing the switch will stop movement of the platform. When the desired level is reached, the user can leave the platform and it will be in position for return travel.

During use of the swim lift platform, hand holds 92 formed in the sidewalls 74 can be used for support. Also, the forward wall can be provided with steps indicated at 96 to assist during boarding and leaving of the platform 64 of the carriage assembly 70.

A modification of the embodiment seen in FIGS. 3 through 5 can be achieved by substituting handrails 40 such as seen in FIG. 1 for the sidewalls 74 seen in FIG. 3. In that case the upper part of the handrail 40 can be joined directly to the top of the forward wall 66 in FIG. 3 instead of to the collars 42 seen in FIG. 1.

A swim platform for boats has been provided which can use power such as a hydraulic cylinder to lower a user into the water and to raise the user from the water without the need for ladders and without the physical effort required using ladders.

What is claimed is:

1. A swim lift platform for attachment to a transom of a boat comprising:

a movable member having a pair of spaced apart generally vertically extended side structures and a generally horizontal platform having opposite sides and being supported at the lower ends of said side structures;

a mounting structure adapted to be fixed to the transom of a boat, said mounting structure including a first pair of parallel spaced flange members;

a pair of parallel spaced guides on said movable member formed as a pair of channel members slidably receiving said pair of flange members to support said movable member for vertical sliding movement between a storage position in which said platform is above water level when said boat is floating in water and a lower position in which said platform is submerged;

a linear hydraulic actuator disposed generally midway between said opposite sides and said guides and acting between said mounting structure and said movable member for moving said movable member between said storage and lower positions; and a control for actuating said hydraulic actuator, said control being accessible to an operator standing on said platform.

2. The swim lift platform of claim 1 wherein said flange members extend away from each other and wherein said channel members each have opening portions facing each other, said open portions receiving said flange members of said mounting structure.

3. The swim lift platform of claim 1 wherein said moveable member has a forward wall connected to said guides and to said platform for movement as a unit between said storage and lower positions.

4. The swim lift platform of claim 3 wherein said forward wall of said moveable member is formed with stationary steps.

5. The swim lift platform of claim 1 wherein said mounting structure has a transverse vertical wall and wherein said flange members are spaced parallel to each other and relative to said transverse wall and extending away from each other.

6. The swim lift platform of claim 5 wherein said moveable member has a forward wall and said transverse vertical wall of said mounting structure is parallel to said forward wall of said moveable member, said walls forming a chamber therebetween to house said hydraulic actuator.

7. The swim lift platform of claim 5 wherein said movable member includes hand gripping surfaces for use by a user standing on said platform.

* * * * *